United States Patent [19]

Tanaka et al.

[11] Patent Number: 4,993,787

[45] Date of Patent: Feb. 19, 1991

[54] ELECTROMAGNETIC RELAY

[75] Inventors: Takashi Tanaka, Takatsuki; Takezo Sano, Shiga; Tsutomu Shimizu, Kusatsu, all of Japan

[73] Assignee: Omron Tateisi Electronics Co., Kyoto, Japan

[21] Appl. No.: 405,327

[22] Filed: Sep. 11, 1989

Related U.S. Application Data

[63] Continuation of Ser. No. 167,192, Mar. 11, 1988.

[51] Int. Cl.[5] ..... H01H 51/22

[52] U.S. Cl. ..... 335/78; 335/80; 335/128

[58] Field of Search ..... 335/78-85, 335/120, 124, 230, 128

[56] References Cited

U.S. PATENT DOCUMENTS 4,551,698 11/1985 Aidn ..... 335/78
4,703,293 10/1987 Ono et al. ..... 335/80

FOREIGN PATENT DOCUMENTS 0118715 9/1984 European Pat. Off. .
0196022 10/1986 European Pat. Off. .
0293199 5/1988 European Pat. Off. .
59-143235 8/1984 Japan .
61-218035 9/1986 Japan .

*Primary Examiner*—Leo P. Picard
*Assistant Examiner*—Lincoln Donovan
*Attorney, Agent, or Firm*—Fish & Richardson

[57] ABSTRACT

An electromagnetic relay having an electromagnetic block with a roughly U-shaped iron core formed with a pair of bent opposing magnetic poles at both the ends thereof and with a coil wound therearound via a spool; and an armature block with both ends thereof opposing the magnetic poles and with the middle portion thereof pivotally supported. A permanent magnet is disposed between the two opposing magnet poles of the iron core so as to oppose said armature. The permanent magnet is supported by a support member formed integral with the spool of the electromagnetic block. The armature is pivotally supported by the electromagnetic block.

4 Claims, 9 Drawing Sheets

ELECTROMAGNETIC RELAY

This application is a continuation of application Ser. No. 167,192, filed Mar. 11, 1988, now U.S. Pat. No. 4,881,053.

BACKGROUND OF THE INVENTION

1. Field of the Invention

The present invention relates to an electromagnetic relay, and more specifically to an electromagnetic relay having a permanent magnet and an armature block pivotally supported at roughly the middle portion thereof.

2. Description of Prior Art

Japanese Patent Kokai (Laid Open) Publication No. 1-218030 discloses an example of prior-art electromagnetic relays, in which an electromagnetic block, a permanent magnet and an armature block are arranged within a housing composed of a base and a casing. The electromagnetic block has an iron core formed into roughly U-shape and with a pair of bent opposing magnetic poles at both the ends thereof and a coil wound around the iron core via a spool. The permanent magnet is disposed between the two magnetic poles with both ends facing the magnetic poles magnetized in the same pole and with the middle portion magnetized in the opposite pole. The armature block is pivotally supported at the middle portion of the permanent magnet with both the ends thereof positioned so as to oppose the magnetic poles, respectively.

In the above-mentioned prior-art electromagnetic relay, however, there exist various problems as follows:

(a) A bonding process is required to fix the permanent magnet onto the electromagnetic block.

(b) Since the movable contacts provided for the armature block and the fixed contacts disposed on the base and opposing the movable contacts are brought into contact with or separated from each other via the electromagnetic block, the permanent magnet bonded to the electromagnetic block and the armature block pivotally supported on the permanent magnet, gap between the fixed contacts and the movable contacts are not uniform, thus resulting in dispersion in dynamic characteristics of the magnetic relay.

(c) Since the electromagnet block, the permanent magnet, and the armature block are disposed one upon another, the height of the relay is inevitably increased, thus increasing the size of the electromagnetic relay.

SUMMARY OF THE INVENTION

It is the object of the present invention to overcome the above drawbacks.

The present invention provides an electromagnetic relay having an electromagnetic block with a roughly U-shaped iron core formed with a pair of bent opposing magnetic poles at both the ends thereof and with a coil wound therearound via a spool; and an armature block with both ends thereof opposing the magnetic poles and with the middle portion thereof pivotally supported, and bringing or separating movable contacts provided for the armature block into contact with or away from fixed contacts by pivoting the armature block on the basis of energization and deenergization of the electromagnetic block, characterized in that a permanent magnet is disposed between the two opposing magnet poles of the iron core so as to oppose said armature; the permanent magnet is supported by a support member formed integral with the spool of the electromagnetic block; and the armature is pivotally supported by the electromagnetic block.

Therefore, bonding process at which the permanent magnet is fixed onto the electromagnetic block can be eliminated, thus simplifying the manufacturing process. Further, since the movable contacts and the fixed contacts are positioned so as to oppose each other via only two members of the electromagnetic block and the armature block, it is possible to decrease the dispersion of operating characteristics of the electromagnetic relay. Further, since the armature block is directly mounted on the electromagnetic block, it is possible to decrease the height of the electromagnetic relay and therefore the size of the relay.

DETAILED DESCRIPTION OF THE PREFERRED EMBODIMENTS

An embodiment of the present invention will be described with reference to the attached drawings.

Figure 1:
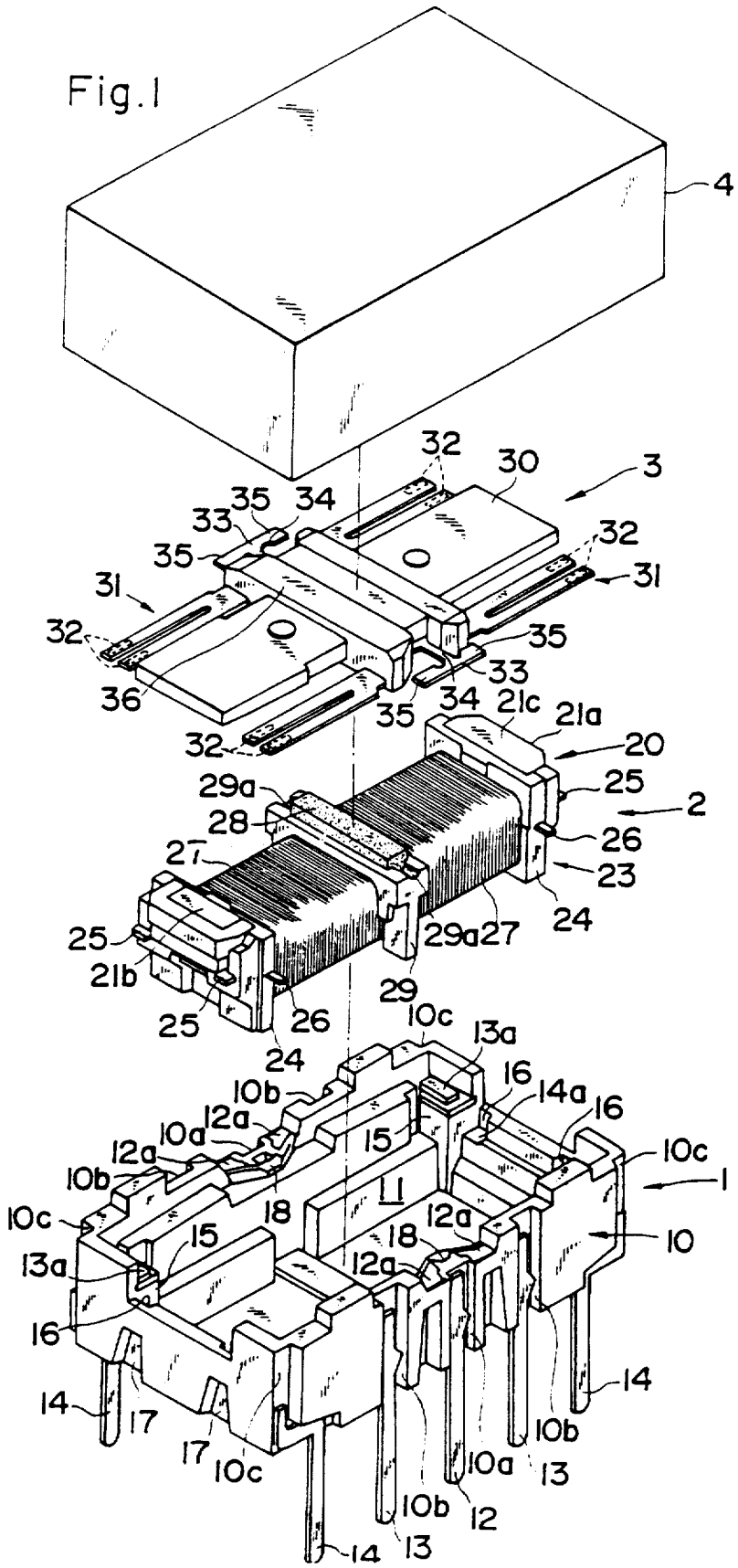
FIG. 1 is an exploded view of the electromagnet relay of the present invention.
Figure 2:
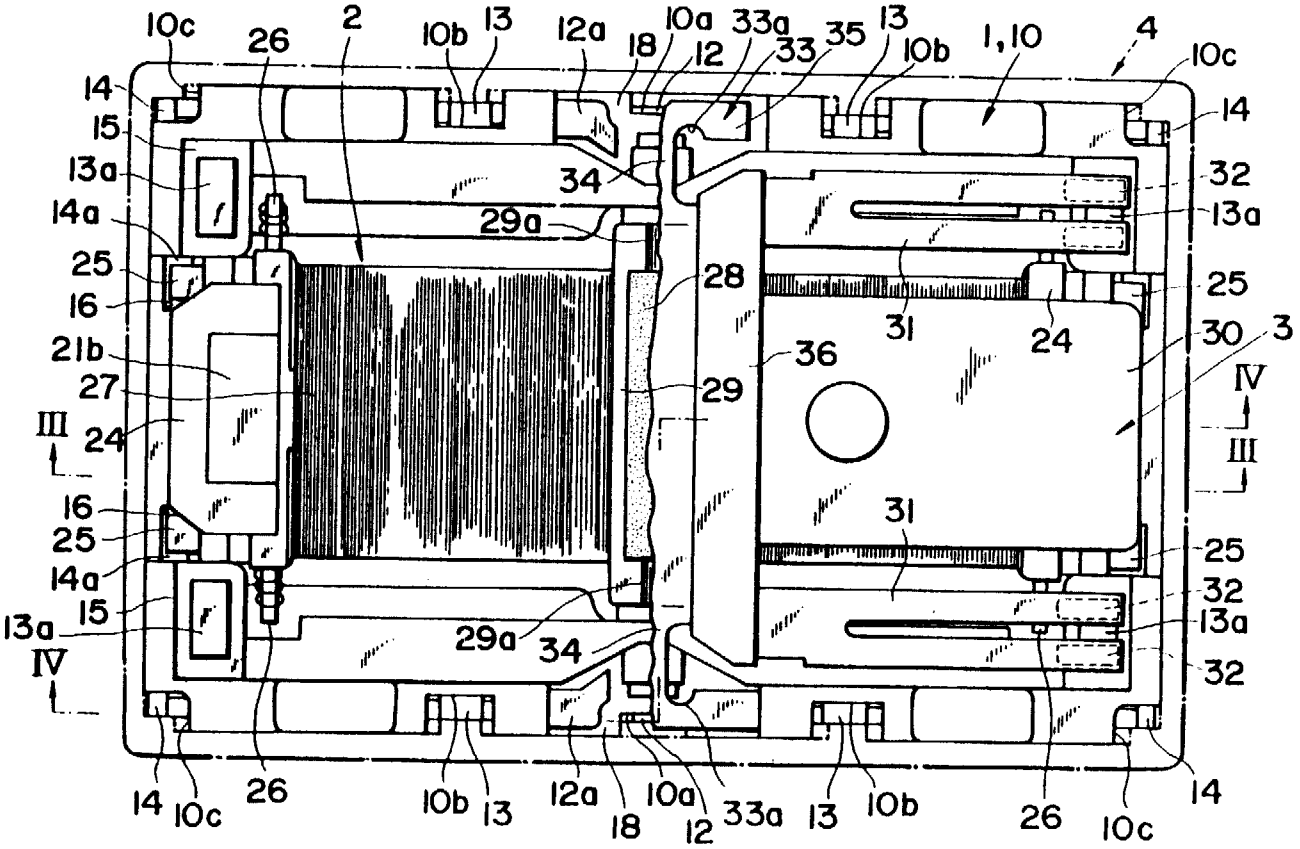
FIG. 2 is a plan view showing the electromagnetic relay of the present invention.

FIGS. 1 to 4 show an electromagnetic relay according to the present invention, which is roughly composed of a base 1, an electromagnetic block 2, an armature block and a casing 4 as shown in FIG. 1.

I. Construction

The construction of the electromagnetic relay of the present invention will be described for each element.

(i) Base 1

The base 1 is made of an insulating synthetic resin. A base body 10 is formed with a housing portion (space) 11 open upward and with vertical grooves 10*a*, 10*b* and 10*c* on both the longitudinal sides thereof. The four grooves 10*b* and 10*c* are arranged on one longitudinal side thereof symmetrically respectively, with respect to the middle groove 10*a*.

A common terminal reed 12, fixed contact terminal reeds 13 and coil terminal reeds 14 are fitted to these grooves 10*a*, 10*b* and 10*c*, respectively. The upper portions of these terminal reeds 12, 13 and 14 are buried within the base body 10 integral therewith. A top end contact portion 12*a* of the common terminal 12 exposes from the upper surface of a recessed portion 18 formed at roughly the middle of the longitudinal side of the body 10; a top end contact portion, namely a fixed contact 13*a* of the fixed contact terminal 13 exposes from the upper surface of stepped portion 15 formed at each corner of the housing portion 11; a top end contact portion 14*a* of the coil terminal 14 exposes from the bottom surface of recessed portion 16 formed inside the stepped portions 15 along the transversal side of the body 10 at a position lower than the stepped portions 15. At the reverse side of the coil terminal contact portion 14*a*, the base body 10 is formed with a guide portion (passage) 17 communicating with the outside of the base body 10, to which a welder electrode is inserted.

The method of molding the base 1 will be described in detail later.

(ii) Electromagnet block 2

The electromagnet block 2 is roughly composed of an iron core 20, a spool 23, coils 27 and a permanent magnet 28.

Figure 3:
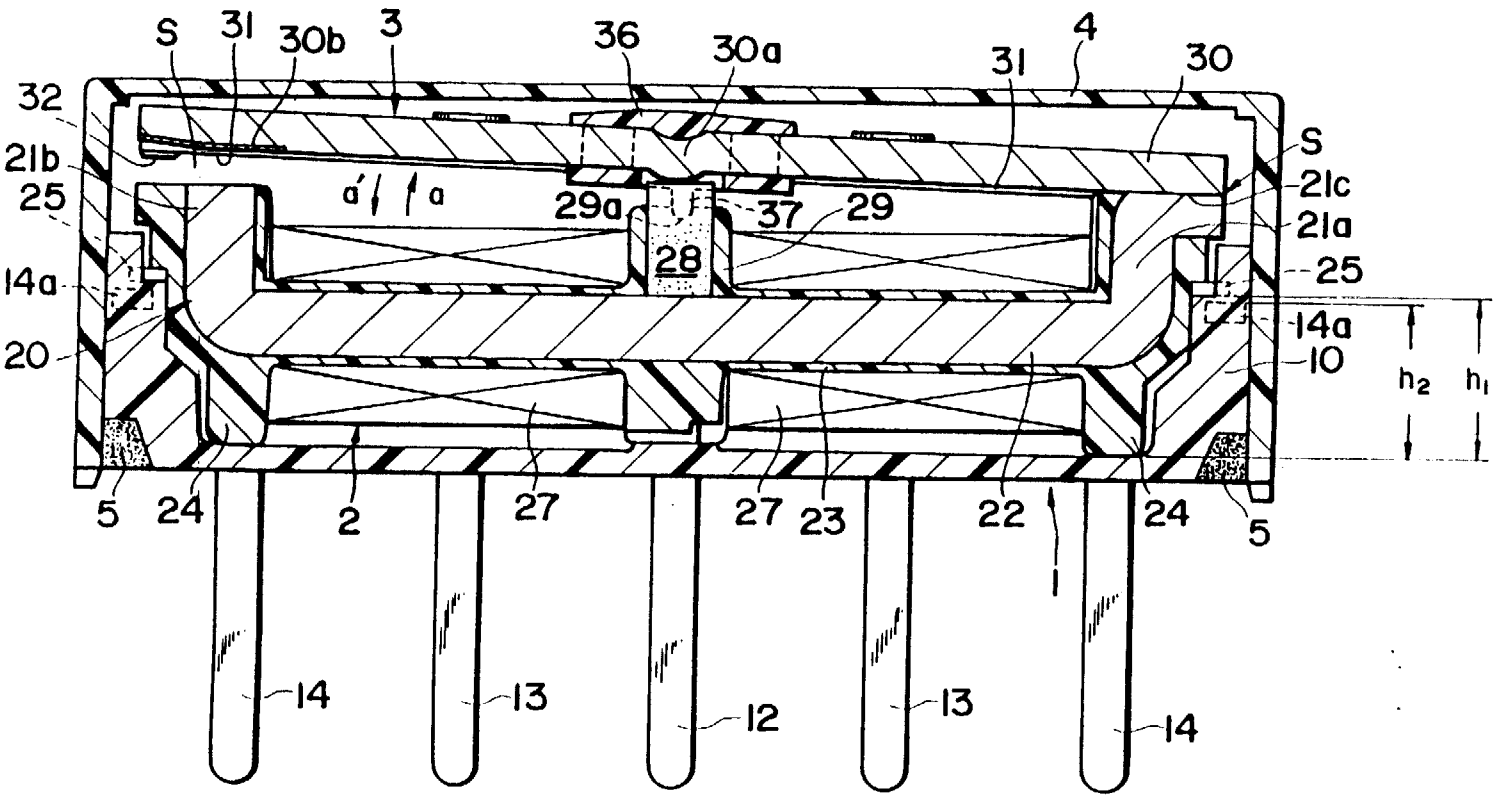
FIG. 3 is a cross-sectional view taken along the line III—III in FIG. 2.
Figure 4:
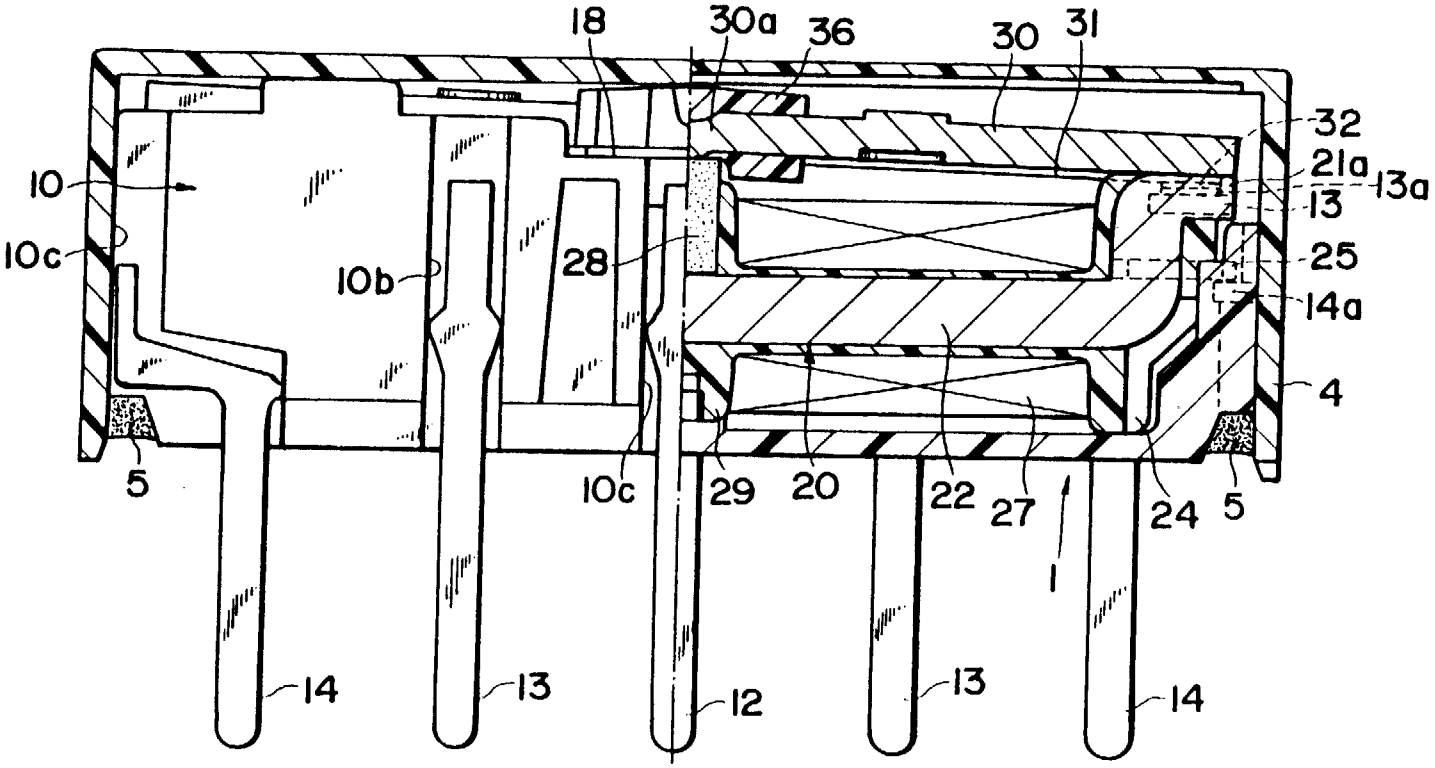
FIG. 4 is a cross-sectional view taken along the line IV—IV shown in FIG. 2.

As shown in FIG. 3, the iron core 20 is formed with two opposing magnetic poles (portions where the magnetic poles appear) 21*a* and 21*b* on both ends of an iron core body 22 by bending upward both the ends of a rectangle plate made of a magnetic material. The upper end portion of one magnetic pole 21*a* is further bent outward to form a horizontal portion 21*c* parallel to the iron core body 22.

The permanent magnet 28 is rectangular in shape and formed with two upper and lower magnetic poles, and is disposed at roughly the middle portion of the iron core body 22.

The spool 23 is formed integral with the iron core 20 so as to cover the iron core body 22, and with flanges 24 at both the ends thereof. A support portion 29 is formed between the two flange portions 24 to support the permanent magnet 28 whose lower portion is buried in the support portion 29 and whose upper portion is exposed. The lower surface of the permanent magnet 28 is almost come into contact with the upper surface of the iron core body 22. Further, the support portion 29 is formed with two semicircular concave grooves 29*a* on the upper surface thereof at the outer positions of the both ends of the permanent magnet 28.

The coils 27 are wound between the two flange portions 24 and the support portion 29 and the coil terminals are electrically connected to coil winding portions 26 of junction terminals 25 buried in and integral with the flange portions 24, respectively.

The spool 23 can be formed by placing the iron core 20 on which the permanent magnet 28 is mounted and the junction terminals 25 at predetermined positions within an upper and lower two-split metallic mold and by injecting resin into the metallic mold. Further, in this process, when resin is injected, since the permanent magnet 28 is pushed upward against the upper metallic mold by the injection pressure, it is possible to accurately determine a distance between the upper surface of the permanent magnet 28 and the bottom of the concave groove 29*a* formed in the support portion 29. In this case, although there exists a gap between the lower surface of the permanent magnet 28 and the upper surface of the iron core body 22, since the gap is small, no problem arises.

Further, when the center portion of the upper surface of the magnetic pole 21*b* is supported so as to form a small gap relative to the upper metallic mold, a thin film is formed on the upper surface of the magnetic pole 21*b* except for the center portion thereof. The gap between the armature 30 and the magnetic pole 21*b* is maintained at a small value, when the armature 30 is attracted to the pole 21*b*, so that a shield plate 30*b*, which is attached to the lower surface of the armature 30 at one end, is not required specially.

(iii) Armature block 3

The armature block 3 is composed of an armature 30, movable contact reeds 31 and a support member 36.

The armature 30 is a rectangular plate made of a magnetic material. The movable contact reed 31 is of twin type, which is formed with movable contacts 32 on both ends thereof and with a T-shaped contact connection portion 33 having a guide portion 34 extending from the middle portion to the sideward direction and wing portions 35 extending along the longitudinal side of the armature 30. The movable contact reeds 31 are positioned in parallel to the longitudinal side of the armature 30 on both the sides thereof, and formed integral with the armature 30 via the support member 36 made of insulating synthetic resin. In the state where the movable contact reeds 31 are attached integrally to the armature 30, the T-shaped connection portion 33 project from the side portion of the support member 36.

On the lower surface and on both the sides of the support portion 36, two convex portions 37 (shown in FIG. 3) are formed so as to be engageable with the concave grooves 29*a* of the electromagnetic block 2. The height of the convex portions 37 is such that there exists a small gap between the lower surface of the armature middle portion 30*a* and the upper surface of the permanent magnet 28 when the convex portions 37 are in engagement with the concave grooves 29*a*.

(iv) Casing 4

The casing 4 is made of a synthetic resin and formed into a box shape so as to cover the base 1.

II. Assembly

The assembling process of the electromagnetic relay thus constructed will be explained hereinbelow.

With reference to FIG. 1, the electromagnetic block 2 is fitted to a housing portion 11 of the base 1 formed by the method described in detail later. In this state, the junction terminals 25 of the electromagnetic block 2 are positioned on the coil terminal connection portions 14*a* exposed on the bottom surfaces of the recessed portions 16 of the base 1, as shown in FIG. 3. In this embodiment, however, as shown in FIG. 3, since the height (h1) from the bottom surface of the spool flange portion 24 to the lower surface of the junction terminal 25 is determined to be a little higher than the height (h2) from the bottom surface of the housing portion 11 to the upper surface of the coil terminal contact portion 14*a*, there exists a gap between the junction terminal 25 and the contact portion 14*a*. Therefore, one of electrodes of a welder (not shown) can be inserted from a guide portion 17 in the upward direction so as to be brought into contact with the lower surface of the coil terminal contact portion 14*a*, and further the other electrode is pushed against the upper surface of the junction terminal 25, in order to weld the junction terminal 25 and the coil terminal contact portion 14a by pushing the former against the latter.

Therefore, the electromagnetic block 2 is firmly fixed to the base 1 under the condition that the block 2 is urged against the base 1 by an elastic force of the junction terminal 25 itself.

Where the junction terminal 25 and the contact portion 14a are welded by a laser beam, the terminal 25 is disposed on and made contact with the contact terminal 14a after the electromagnetic block 2 is fitted to the base 1. In this case the guide portion 17 is unnecessary.

Next, as shown in FIG. 3, the convex portions 37 of the armature block 3 are fitted to the concave grooves 29a of the electromagnetic block 2 in order to pivotally support the armature block 3 in the arrow directions a and a' with the contact points of the convex portions 37 and the concave grooves 29a as its fulcrum.

Here, since a space between the upper surface of the permanent magnet 28 and the bottom of the concave grooves 29a is accurately determined in forming the spool 23 of the electromagnetic block 2 as described already, a small gap between the lower surface of the armature 30 supported by the cancave grooves 29a and the upper surface of the permanent magnet 28 can be retained accurately.

Both ends of the armature 30 are positioned on the upper surfaces of the magnetic poles 21a and 21b of the electromagnetic block 2 so as to form working spaces S therebetween, respectively. Therefore, a magnetic circuit connecting the permanent magnet 28, the iron core 20 and the armature 30 can be formed on the basis of the magnetic force generated by the permanent magnet 28.

In the T-shaped connection portions 33 of the movable contact reeds 31, the wing portions 35 thereof are positioned on the common terminal contact portions 12a, respectively. The movable contacts 32 are opposingly placed on or above the fixed contacts 13a, as shown in FIG. 3, in such a way that the right-side movable contacts 32 (in FIG. 3) are brought into contact with the fixed contacts 13a when the armature block 2 is moved in the arrow direction a (clockwise) and the left-side contacts 32 are separated away from the fixed contacts 13a to form a working space S therebetween.

Thereafter, the ends of the wing portions 35 of the T-shaped connection portion 33 are welded to the connection portions 12a, respectively.

In the T-shaped connection portion 33, since the guide portion 34 is formed slender and further semicircular cutout portions 33a (shown in FIG. 2) are formed at the joint portions of the wings 35, the torsion resistance of the guide portion 34 and the bending rigidity of the joint portion of the wing 35 are both reduced, thus allowing a smooth pivotal motion of the armature block 3.

Lastly, the base 1 on which internal components are fitted as described above is covered by the casing 4, and the space between the base 1 and the casing 4 is filled with a resin 5 for sealing.

III. Operation

The operation of the electromagnetic relay formed as described above will be described hereinbelow.

When no voltage is applied to the coil terminals 14 or under deenergization conditions, since the area of the magnetic pole 21a opposing to the armature 31 is broader than that of the magnetic pole 21b opposing to the same and magnetically unbalanced, the armature 31 is operated in the arrow direction a (clockwise) as shown in FIG. 3.

When a voltage is applied to the coil terminals 14 to pass current through the right and left coils 27 or the current flowing direction is switched-over under energization condition, as shown in FIG. 3, the armature block 3 is pivoted in the arrow direction a or a' with the contact point between the concave grooves 29a and the convex portions 37 as its fulcrum, so that left side or right side the movable contacts 32 are brought into contact with or separated away from the corresponding fixed contacts 13a.

Although the concave grooves 29a and convex portions 37 are in friction contact with each other when the armature block 3 is being pivoted, since these two parts are made of synthetic resin, resin powder will not be produced due to friction.

Further, since there exists a predetermined gap between the lower surface of the middle portion 30a of the armature 30 and the upper surface of the permanent magnet 28, the pivotal motion will not be disturbed due to the direct contact between the two. Further, since this gap is determined to be small, the magnetic efficiency of the permanent magnet 28 is not lowered, thus permitting a stabilized operation.

IV. Method of molding base and terminals

The method of molding the base 1 and the terminals 2, 13 and 14 formed integral therewith will be described hereinbelow with reference to FIGS. 5 to 10.

Figure 5:
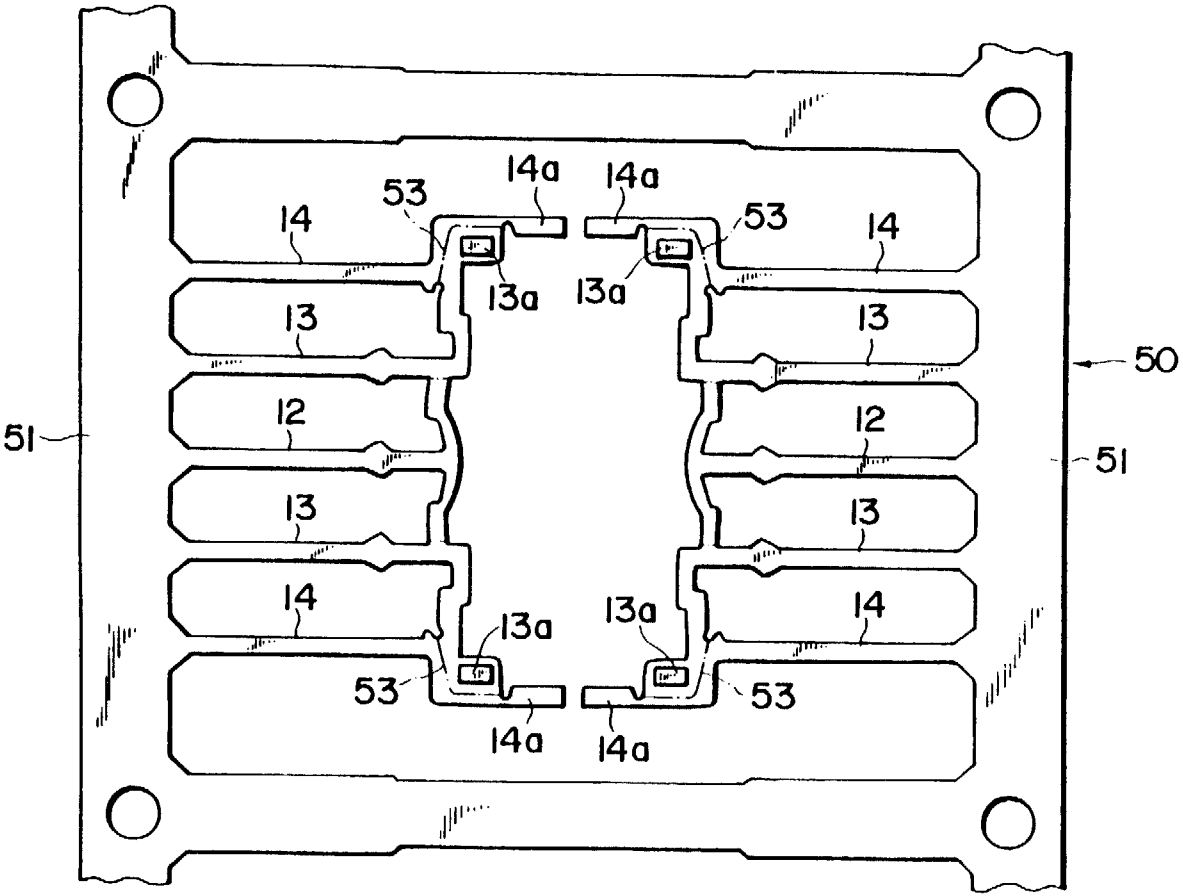
FIGS. 5 and 6 are plan views showing a reed frame.
Figure 6:
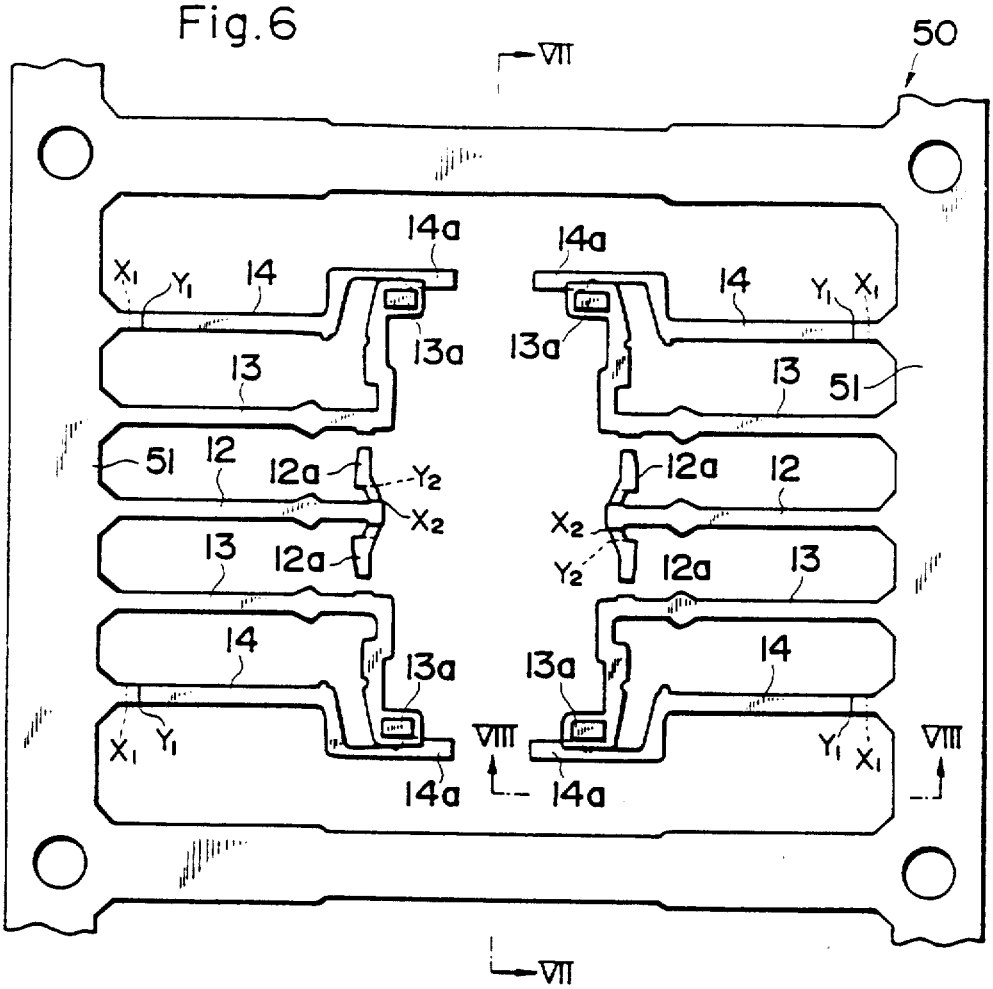

First, the terminals 12, 13 and 14 are formed as a reed frame 50 as shown in FIG. 5 by punching out a conductive plate. In FIG. 5, the terminals 12, 13 and 14 are formed inside the right and left base portions 51 in symmetrical relationship to each other in such a way that the two fixed contact terminals 13 and the two coil terminals 14 are arranged on both the sides, respectively, in the vertical direction in the drawing in symmetrical relationship with respect to the common terminal 12.

The ends of the two upper and lower fixed contact terminals 13 are formed integral with the coil terminals 14 without forming gaps between the contact terminals and coil terminals. Further, a distance between the two upper and lower fixed contacts 13a is determined as remote as possible from each other.

Therefore, it is possible to increase the distance between the two movable contacts of the movable contact reed 31. In other words, it is possible to lengthen the movable contact reed 31 and to stabilize the operation characteristics of the electromagnetic relay of less dimensional dispersion. In addition, since the distance between the spool flanges 24 can be increased, it is possible to increase the number of turns of the coil 27 wound around the electromagnetic block 2, thus generating a large magnetomotive force.

Figure 7:
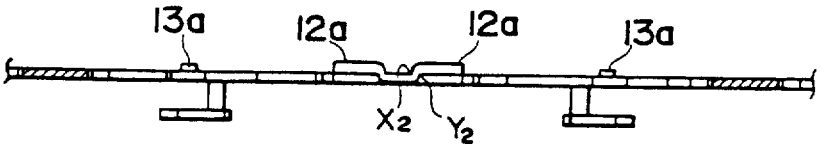
FIG. 7 is a cross-sectional view taken along the lines VII—VII shown in FIG. 6.
Figure 8:
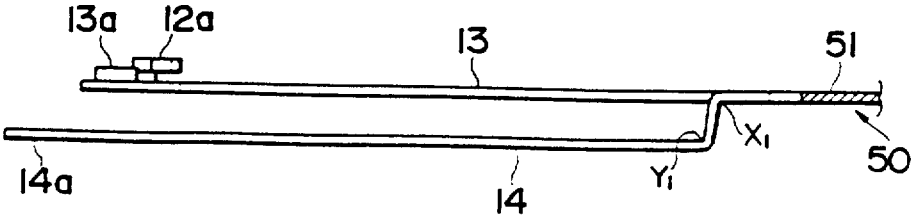
FIG. 8 is a cross-sectional view taken along the lines VIII—VIII shown in FIG. 6.

Thereafter, the reed frame 50 is shifted to a press step, at which the contact terminals 13 and the coil terminals 14 are cut off along cutting lines 53 to separate them. The coil terminals 14 are bent once downward (as shown in FIG. 8) at dotted lines X1 (also shown in FIG. 6) and then horizontally at solid lines Y1 in parallel to the reed frame 50. On the other hands, the common terminals 12 are first bent upward at the solid line X2 (as shown in FIG. 7) and then horizontally at dotted lines Y2 in parallel to the reed framce 50 to form the contact portions 12a. By this, the coil terminals 14 are set at a position lower than the fixed contact terminals 13, so that the coil terminals 14 will not interfere with the fixed contact terminals 13.

Figure 9:
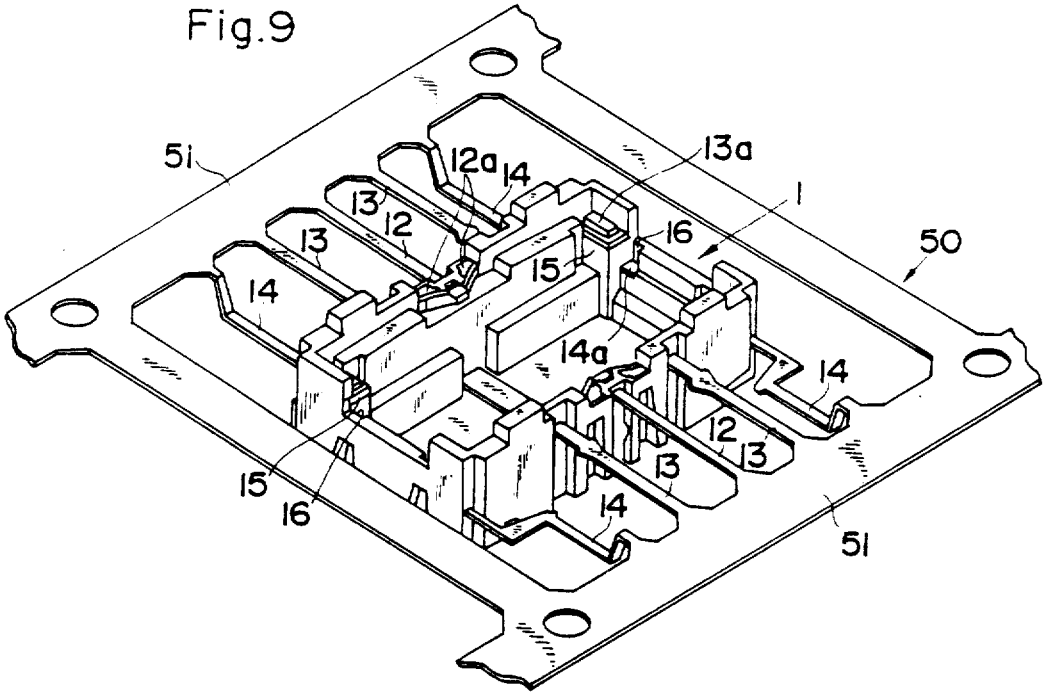
FIGS. 9 and 10 are perspective views showing base molding processes.

The reed frame 50 manufactured as described above is shifted to the succeeding base forming process. In this process, the reed frame 50 is fixed between two upper and lower split metallic molds, and then resin is injected into the mold to form the base 1. By doing this, the top ends of these terminals 12, 13 and 14 are buried within the base 1 as shown in FIG. 9 in such a way that the end contacts or the contact portions 12*a*, 13*a* and 14*a* of the terminals 12, 13 and 14 are exposed on the upper surfaces of the recessed portions 18, the stepped portion 15 and on the bottom surface of the recessed portions 16.

As described above, since the ends of the terminals 12, 13 and 14 will not project much from the surfaces of the base 1 but only the contacts or the contact portions 12*a*, 13*a* and 14*a* are exposed, it is possible to avert the danger in that when the upper and lower molds are engaged with each other, the ends of the terminals 12, 13 and 14 are brought into contact with the mold and into bent or broken conditions. Therefore, it is possible to simplify the structure of the metallic mold and reduce the machining cost, and to improve productivity by increasing the metal mold setup speed.

Figure 10:
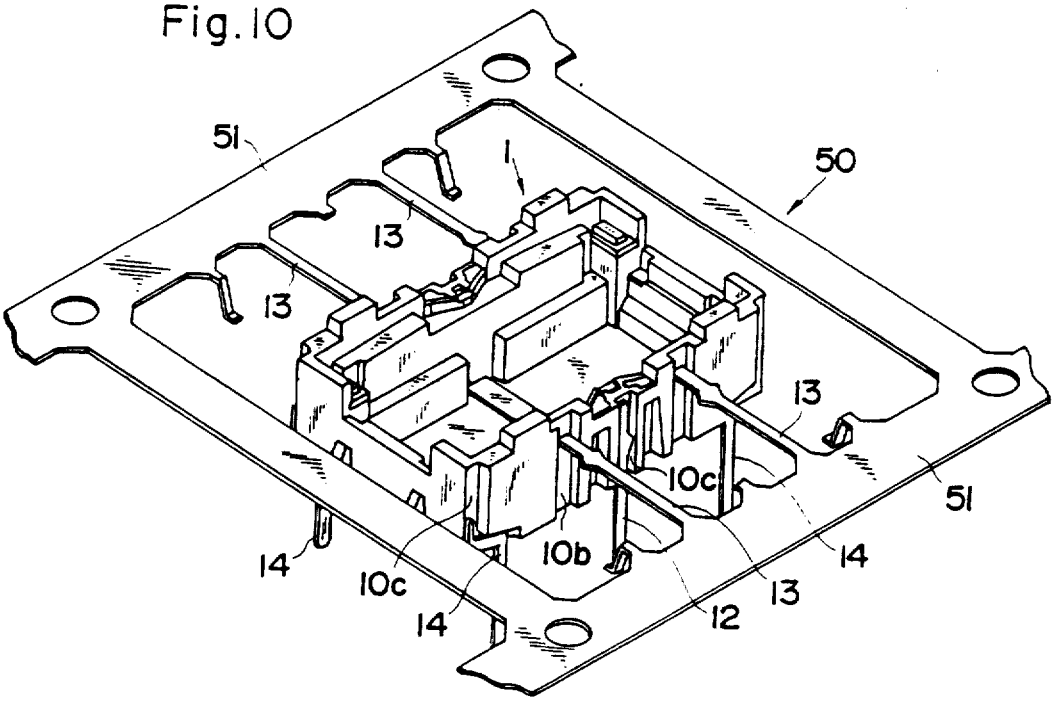

Thereafter, the common terminals 12 and the contact terminals 14 are cut off at positions connected to the reed frame 50 as shown in FIG. 10, and then bent at the contact portions with the base 1 downward so as to be fitted to the grooves 10*a* and 10*c*. In this state, the fixed contact terminals 13 are still connected to the reed frame 50. Under these conditions, the base 1 is moved to the succeeding assembly step, at which the electromagnetic block 2 and the armature block 3 are mounted on the base 1. The terminals 13 are separated from the reed frame 50 before the casing 4 is attached to the base 1, and the terminals 13 protruding from the base 1 are bent downward at the contact portions with the base 1 into the state as shown in FIG. 1.

That is to say, the base 1 is conveyed being supported by the reed frame 50 (with the reed frame 50 as a carrier) along the assembly line.

The above-mentioned method has the following advantages as compared with the method that all the terminals 12, 13 and 14 are cut away from the reed frame 50 and the subassembled product is conveyed along the assembly line:

It is unnecessary to mount the base 1 on a platen and therefore no platen is required.

Further when the base 1 is conveyed being mounted on a platen, the base 1 is located in position in contact with a stopper before being assembled. In the prior-art method, there exists a problem in that the location of the base 1 is dislocated due to the backlash produced when the base collides against the stopper so that the assembling precision is degraded. In contrast with this, in the present method as described above, since the reed frame 50 is used as a carrier, it is possible to accurately position the base 1 as well as the reed frame 50, so that it is possible to improve the assembling precision and therefore the product quality.

Further, in checking the characteristics of the products during assembly process, since only the common terminals 12 and the coil terminals 14 protrude from the lower surface of the base 1 (without protruding the fixed contact terminal 13 between the terminals 12 and 14) and the distances between the terminals 12 and 14 are wide, it is possible to easily connect test probes to the terminals 12 and 14, thus allowing in-line adjustment (the product characteristics are adjusted immediately at each time). Further, although the fixed contact terminals 13 are conductive via the reed frame 50, it is possible to measure all the characteristics required in relay adjustment process even this conductive state, without raising special problems.

V. Core shape

Figure 11:
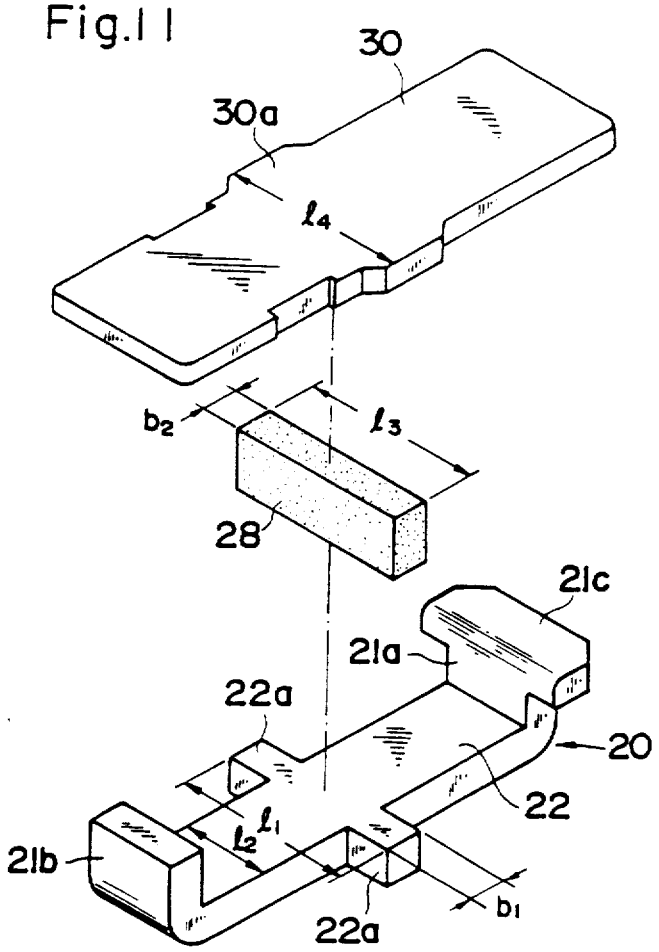
FIG. 11 is a perspective view showing the iron core, the armature and the permanent magnet.

The shapes of the iron core 20, the permanent magnet 28 and the armature 30 will be described with reference to FIG. 11.

A body 22 of the iron core 20 is formed with two protruding portions 22*a* at roughly the middle portion thereof on both the sides thereof. In the same way, the armature 30 is formed with two protruding portions 30*a* at roughly the middle portion thereof on both the sides thereof. The width l1 of the two protruding portions 22*a* is about twice wider than that l2 of the iron core body 22 but the same as the l3 (longitudinal direction) of the permanent magnet 28, and further l4 of the armature middle portion 30*a*. The width b1 of the protruding portion 22*a* is the same as that b2 of the permanent magnet 28.

In the above-mentioned shape, since the permanent magnet 28, the iron core protruding portions 22*a* and the armature 30 are arranged with these both ends kept flush with each other, it is possible to improve the magnetic efficiency of a magnetic circuit composed of the iron core 20, the permanent magnet 28 and the armature 30.

Further, when the width b2 of the permanent magnet 28 is reduced to increase the number of turns of the coil 27 wound around the body 22, it is possible to increase the magnetomotive force of the electromagnetic block 2. Further, when the thickness of the permanent magnet 28 is reduced and the height of the electromagnetic block 2 is reduced, it is possible to miniaturize the electromagnetic relay.

Further, when the permanent magnet 28 is molded at the supporting portion 29 of the spool 23 together therewith as in the above-mentioned embodiment, the permanent magnet 28 can be located with the end surface of the permanent magnet 28 kept flush with the end surfaces of the protruding portions 22*a* of the iron core 20, so that it is possible to mold the spool under the condition that the permanent magnet 28 is accurately positioned relative to the iron core 20.

VI. Resin flow countermeasures

When the casing 4 is fitted to the base 1 and the outer circumference of the base 1 is filled with resin 5, the resin 5 flows along grooves 10*a*, 10*b* and 10*c* formed on the outside portions of the base 1. Therefore, when the T-shaped connection portion 33 of the armature block 3 is positioned on a recessed portion 18 formed on the outer wall surface of the base 1 as in the above embodiment, since resin 5 comes into between the guide portion 34 of the T-shaped connection portion 33 and the base 1 on the basis of capillary phenomenon and is solidified therebetween, there exists a problem in that the pivotal motion of the armature block 3 is obstructed and therefore the desired operation characteristics are not obtained.

Figure 13:
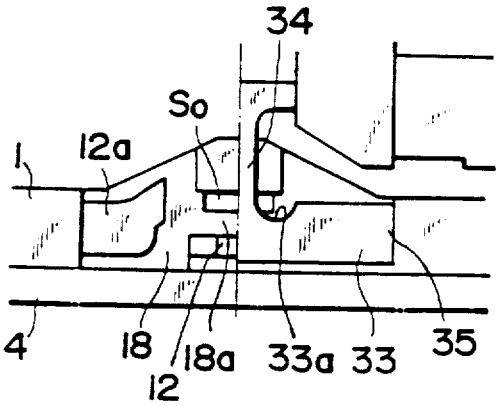
FIG. 13 is a partial enlarged plan view of the electromagnetic relay.
Figure 14:
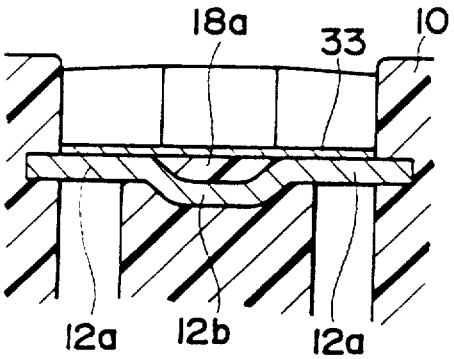
FIGS. 14 and 15 are partial enlarged cross-sectional views of the electromagnetic relay.
Figure 15:
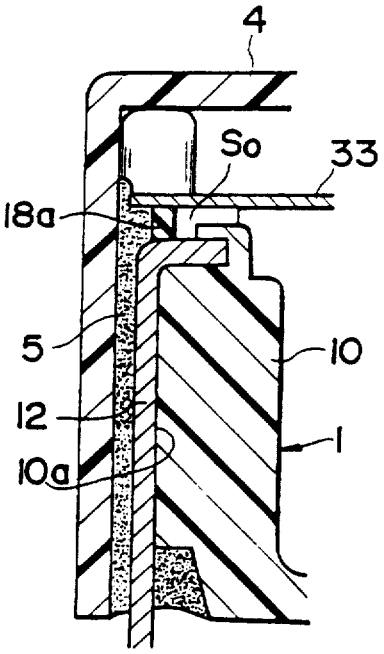

To overcome this problem, in this embodiment, as shown in FIGS. 13, 14 and 15, the top ends of the common terminals 12 are formed into a T-shape and the contact portions 12*a* are formed by once bending the ends upward and then horizontally. Therefore, when the base portion 12b between two contact portions 12a is buried in the base 1, a partition 18a is formed thereon and a gap So is formed between the guide portion 34 and the base 1 therewithin.

Therefore, resin 5 flowing along the groove 10a is first blocked by the partition 18a, so that the amount of resin 5 flowing toward the inside thereof is minimized. Further, the passage of the resin 5 flowing beyond the partition 18a is broadened by the gap So (without producing capillary phenomenon), so that the resin stops flowing at the partition 18a without being solidified between the base 1 and the guide portion 34.

VII. Shape of magnetic poles

Figure 12:
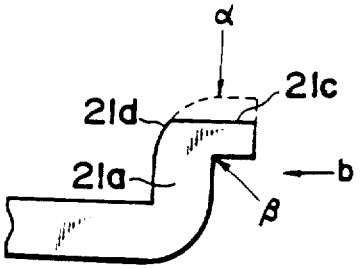
FIG. 12 is a side view showing a magnetic pole of the iron core.

When an end of the magnetic pole 21a is simply bent, the horizontal portion 21c is formed as shown in FIG. 12 by dot lines; that is, the upper flat surface area is very small, so that the magnetic efficiency between the magnetic pole 21a and the armature 30 is low.

To overcome this problem, in this embodiment, force is applied to the magnetic pole 21a from the arrow $\alpha$ direction to sharpen the corner portion 21d and then the upper surface of the horizontal portion 21c is beaten from the arrow $\alpha$ direction to broader the upper flat surface area.

Therefore, the end surface of the magnet pole 21a can be shifted toward the inside thereof (in the arrow b direction), so that the longitudinal length of the iron core 20 is shortened to make compact the electromagnetic relay and further the area opposing the armature 30 can be increased to prevent magnet flux leakage and improve the magnetic efficiency. Alternatively, the upper surface of the magnetic pole 21a can be cut flat by a shaving machine.

In the above embodiment, the flat portion 21c is formed in the magnetic pole 21a. However, when the relay is designed as latching type relay, the flat portion is also formed in both the right and left magnetic poles 21a and 21b.

VIII. Other embodiments

In the above embodiment, the armature block 3 is supported by the supporting portion 29. However, the block 3 can be supported by the permanent magnet 28. The above mentioned embodiment relates to a electromagnetic relay of double-pole double-throw type. However the present invention can be adapted to a double-pole single-throw type, single-pole double-throw and single-pole single-throw type.

What is claimed is:

1. An electromagnetic relay, comprising:

a base made of insulating material and including a fixed contact terminal member provided with a fixed contact and a common terminal member provided with a contact portion;

an electromagnetic block including a substantially U-shaped core formed with a pair of magnetic poles, one of said magnetic poles at each end thereof, a coil wound on a spool around the core, and a permanent magnet disposed adjacent to the center of the core between the two magnetic poles; and an armature block provided with an armature and a movable contact and pivotally supported on the electromagnetic block at substantially the middle thereof to move the movable contact into contact with or away from the fixed contact on the basis of energization or deenergization of the electromagnetic block, wherein said armature block further comprises a contact connection member having wing portions extending along a longitudinal side of the armature, which contact connection member is connected to the movable contact and extends from the middle portion thereof to the sideward direction, the contact connection member being fixed and electrically connected by both ends of each of said wing portions to the contact portion of the common terminal member at an end thereof.

2. An electromagnetic relay as defined in claim 1, wherein the contact connection member is fixed to the contact portion of the common terminal member at the end thereof and arranged so as to allow smooth pivotal motion of the armature block.

3. An electromagnetic relay as defined in claim 1, wherein said armature block is further provided with a movable contact member formed with the movable contact and the contact connection member.

4. An electromagnetic relay as defined in claim 1, wherein said armature block is provided with a movable contact member formed with the movable contact, and wherein the movable contact member and the contact connection member are fixed to the armature through insulating material.

* * * * *

UNITED STATES PATENT AND TRADEMARK OFFICE

CERTIFICATE OF CORRECTION

PATENT NO. : 4,993,787

DATED : February 19, 1991

INVENTOR(S) : Takashi Tanaka et al

It is certified that error appears in the above-indentified patent and that said Letters Patent is hereby corrected as shown below:

On title page, add

Foreign Application Priority Data

(30) March 13, 1987 (JP) Japan . . . . . 62-59561

Signed and Sealed this

Twenty-fourth Day of August, 1993

*Attest:*

*Attesting Officer*

BRUCE LEHMAN

*Commissioner of Patents and Trademarks*